US011391432B1

(12) United States Patent
Kang

(10) Patent No.: US 11,391,432 B1
(45) Date of Patent: Jul. 19, 2022

(54) LAMP FOR VEHICLE AND VEHICLE INCLUDING THE SAME

(71) Applicant: HYUNDAI MOBIS CO., LTD., Seoul (KR)

(72) Inventor: Dong Hwa Kang, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/489,849

(22) Filed: Sep. 30, 2021

(30) Foreign Application Priority Data

Jun. 30, 2021 (KR) ..... 10-2021-0086037

(51) Int. Cl.
*F21S 41/29* (2018.01)
*F21S 41/43* (2018.01)
*F21S 41/47* (2018.01)
*F21S 41/25* (2018.01)

(52) U.S. Cl.
CPC ..... *F21S 41/43* (2018.01); *F21S 41/25* (2018.01); *F21S 41/29* (2018.01); *F21S 41/47* (2018.01)

(58) Field of Classification Search
None
See application file for complete search history.

(56) References Cited

U.S. PATENT DOCUMENTS

2017/0241607 A1* 8/2017 Courcier ..... F21S 41/143
2017/0307166 A1* 10/2017 Courcier ..... F21S 41/663

FOREIGN PATENT DOCUMENTS

DE 4329332 A1 3/1994
DE 112017006014 T5 9/2019
DE 102019218776 A1 6/2020
JP 2020-59377 A 4/2020

OTHER PUBLICATIONS

Office Action dated Feb. 10, 2022 in corresponding German application No. 102021127468.0.

* cited by examiner

*Primary Examiner* — Elmito Breval
(74) *Attorney, Agent, or Firm* — NovoTechIP International PLLC

(57) ABSTRACT

A lamp for a vehicle according to the present disclosure includes a light source part, a shield part disposed on an output side of the light source part, and that shields a portion of light irradiated from the light source part to form a specific beam pattern, and a lens part disposed on an output side of the shield part, that projects the light irradiated from the light source part, and including a plurality of lenses disposed to be spaced apart from each other in an optical axis direction, at least one of the plurality of lenses is a first lens, and a first surface of the first lens is concave and a second surface of the first lens, which is a surface that is opposite to the first surface, is convex.

10 Claims, 9 Drawing Sheets

LAMP FOR VEHICLE AND VEHICLE INCLUDING THE SAME

CROSS-REFERENCE TO RELATED APPLICATIONS

This application claims the benefit of priority to Korean Patent Application No. 10-2021-0086037, filed in the Korean Intellectual Property Office on Jun. 30, 2021, the entire contents of which are incorporated herein by reference.

BACKGROUND OF THE INVENTION

1. Field of the Invention

The present disclosure relates to a lamp for a vehicle and a vehicle including the same, and more particularly, to a lamp for a vehicle that may implement a clear image pattern, and a vehicle including the same.

2. Discussion of Related Art

In general, guide lamps provided in a vehicle include a rear guide lamp and a turn signal guide lamp. Among them, the rear guide lamp is a lamp that is turned on or off together with a rear lamp and functions to prevent an accident by delivering an intention of rearward movement of a vehicle to surrounding vehicles and pedestrians and inform other vehicles of a travel direction of the vehicle by projecting light to a road surface on a lateral rear side, thereby preventing an accident. The turn signal lamp is a lamp that functions to inform other vehicles of a travel direction of a vehicle when a lane of the vehicle is changed during driving of the vehicle or at a crossroad.

The guide lamp of the vehicle may implement a pattern image having a specific shape to a road surface by projecting light to a road surface that is adjacent to a vehicle. A conventional guide lamp may employ a multi-faceted reflector (hereinafter, referred to as an MFR) or the like.

However, when the conventional MFR type guide lamp is used, it is difficult to implement a precise image pattern. Furthermore, when the MFR type guide lamp is used, only a simple image pattern may be implemented, and light sources corresponding to the number of patterns that to be implemented are necessary because the multiple patterns cannot be shielded when the pattern are implemented, and thus costs increase and the weight of the guide lamp increases.

Accordingly, it is necessary to improve a technology capable of implementing a precise image pattern and implementing patterns of various forms.

BRIEF SUMMARY OF THE INVENTION

The present disclosure has been made to solve the above-mentioned problems occurring in the prior art while advantages achieved by the prior art are maintained intact.

An aspect of the present disclosure provides a lamp for a vehicle that improves an optical performance by minimizing aberrations and implementing an image of a precise pattern, and a vehicle including the same.

The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, a lamp for a vehicle includes a light source part, a shield part disposed on an output side of the light source part, and that shields a portion of light irradiated from the light source part to form a specific beam pattern, and a lens part disposed on an output side of the shield part, that projects the light irradiated from the light source part, and including a plurality of lenses disposed to be spaced apart from each other in an optical axis direction, at least one of the plurality of lenses is a first lens, and a first surface of the first lens, which is any one of a surface of the first lens, which faces the light source part, and a surface of the first lens, which faces a direction that is opposite to a direction facing the light source part, is concave and a second surface of the first lens, which is a surface that is opposite to the first surface, is convex, the first lens includes a central portion located at a central area of the first lens, and an edge portion located at an edge area of the first lens and disposed at a circumference of the central portion, and an absolute value of a radius of curvature of the first surface of the edge portion is smaller than an absolute value of a radius of curvature of the first surface of the central portion.

The edge portion may be located within a clear aperture of the first lens.

One or a plurality of first lenses may be provided.

In the first lens, an absolute value of a radius of curvature of the first surface and an absolute value of a radius of curvature of the second surface may be different.

The absolute value of the radius of curvature of the first surface of the edge portion may be larger than an absolute value of a radius of curvature of the second surface of the edge portion.

The lens part may further include a second lens disposed while sharing the same optical axis with the first lens.

The light source part may include a light source that irradiates light, and a condensing member that condenses the light irradiated from the light source and inputs the condensed light to the lens part.

The lamp may further include a housing having an interior space, in which the light source part, the shield part, and the lens part are sequentially accommodated.

The housing may include, in an interior thereof, a light source mounting part, on which the light source part is mounted, a shied mounting part spaced apart from the light source mounting part, and on which the shield part is mounted, and a lens mounting part spaced apart from the shield mounting part, and on which at least one of the plurality of lenses is mounted.

According to an aspect of the present disclosure, in a vehicle including a lamp, the lamp includes a light source part, a shield part disposed on an output side of the light source part, and that shields a portion of light irradiated from the light source part to form a specific beam pattern, and a lens part disposed on an output side of the shield part, that projects light irradiated from the light source part, and including a plurality of lenses disposed in an optical axis direction, at least one of the plurality of lenses is a first lens, and a first surface of the first lens, which is any one of a surface of the first lens, which faces the light source part, and a surface of the first lens, which faces a direction that is opposite to a direction facing the light source part, is concave and a second surface of the first lens, which is a surface that is opposite to the first surface, is convex, the first lens includes a central portion located at a central area of the first lens, and an edge portion located at an edge area of the first lens and disposed at a circumference of the central portion, and an absolute value of a radius of curvature of the first surface of the edge portion is smaller than an absolute value of a radius of curvature of the first surface of the central portion.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION OF THE INVENTION

Hereinafter, embodiments of the present disclosure will be described in detail with reference to the accompanying drawings.

First, the embodiments described herein are embodiments that are suitable for understanding the technical features of a lamp for a vehicle and a vehicle including the same according to the present disclosure. However, the present disclosure is not limited to the embodiment described below or the technical features of the present disclosure are not limited by the described embodiments, and the present disclosure may be variously modified without departing from the technical scope of the present disclosure.

Figure 1:
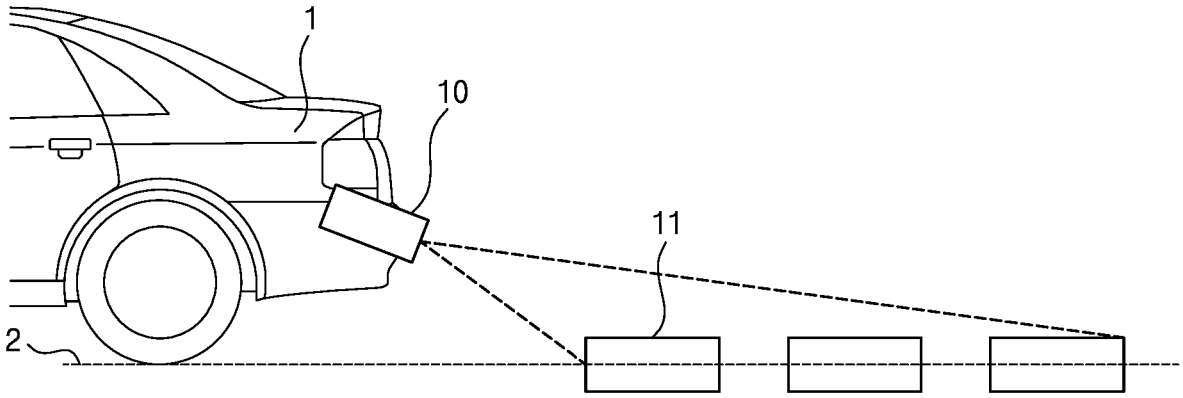
FIG. 1 is a view illustrating an example, in which a lamp for a vehicle is installed in a vehicle according to an embodiment of the present disclosure.
Figure 2:
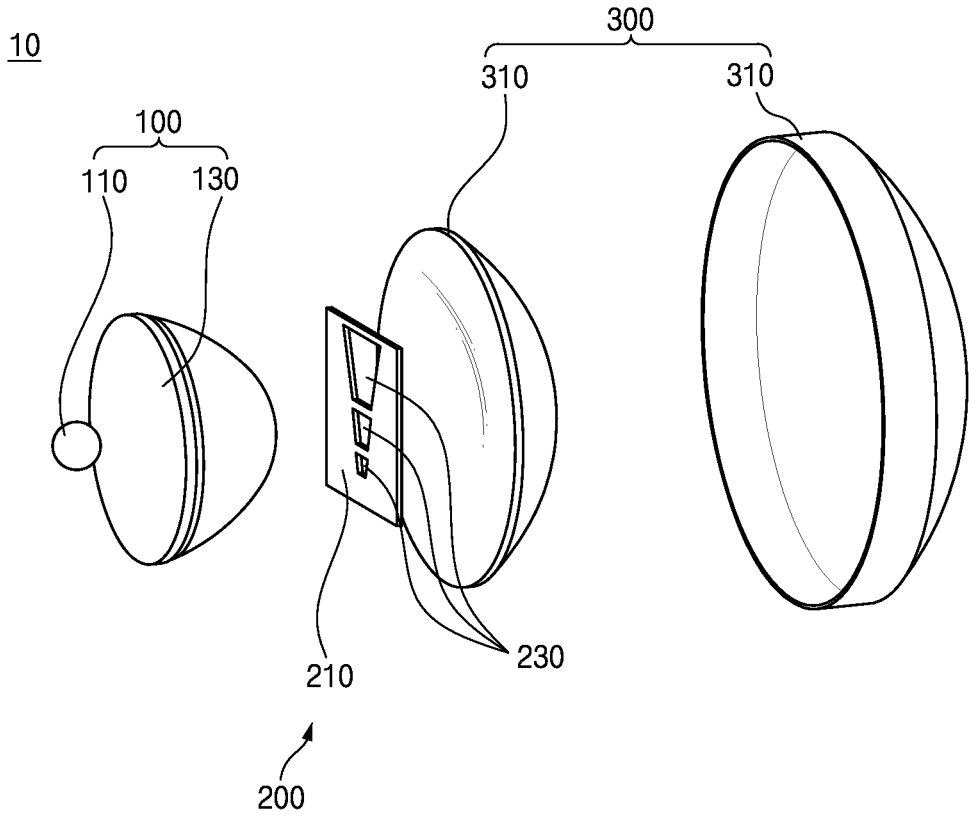
FIG. 2 is a perspective view schematically illustrating a configuration of a lamp for a vehicle according to an embodiment of the present disclosure.
Figure 3:
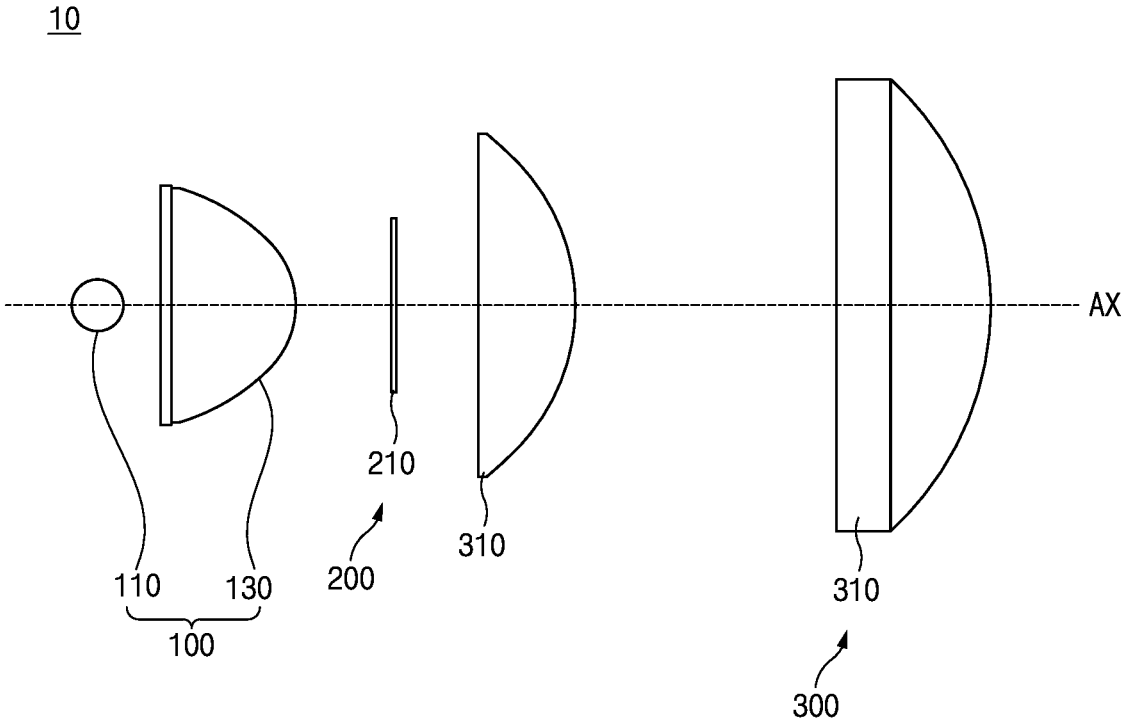
FIG. 3 is a side view schematically illustrating a configuration of a lamp for a vehicle according to an embodiment of the present disclosure.
Figure 4:
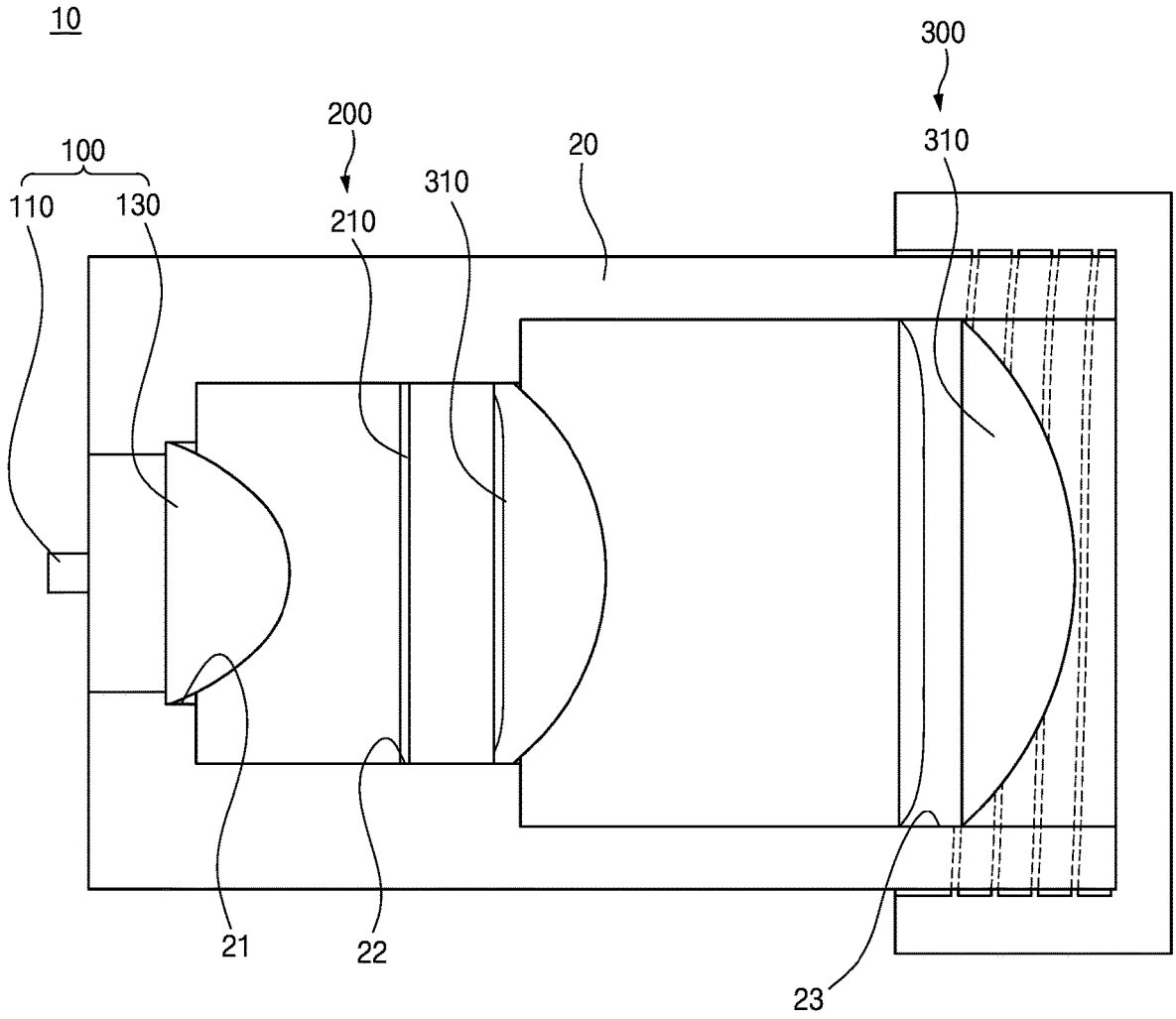
FIG. 4 is a cross-sectional view illustrating a configuration, in which a lamp for a vehicle is mounted in an interior of a housing, according to an embodiment of the present disclosure.
Figure 5:
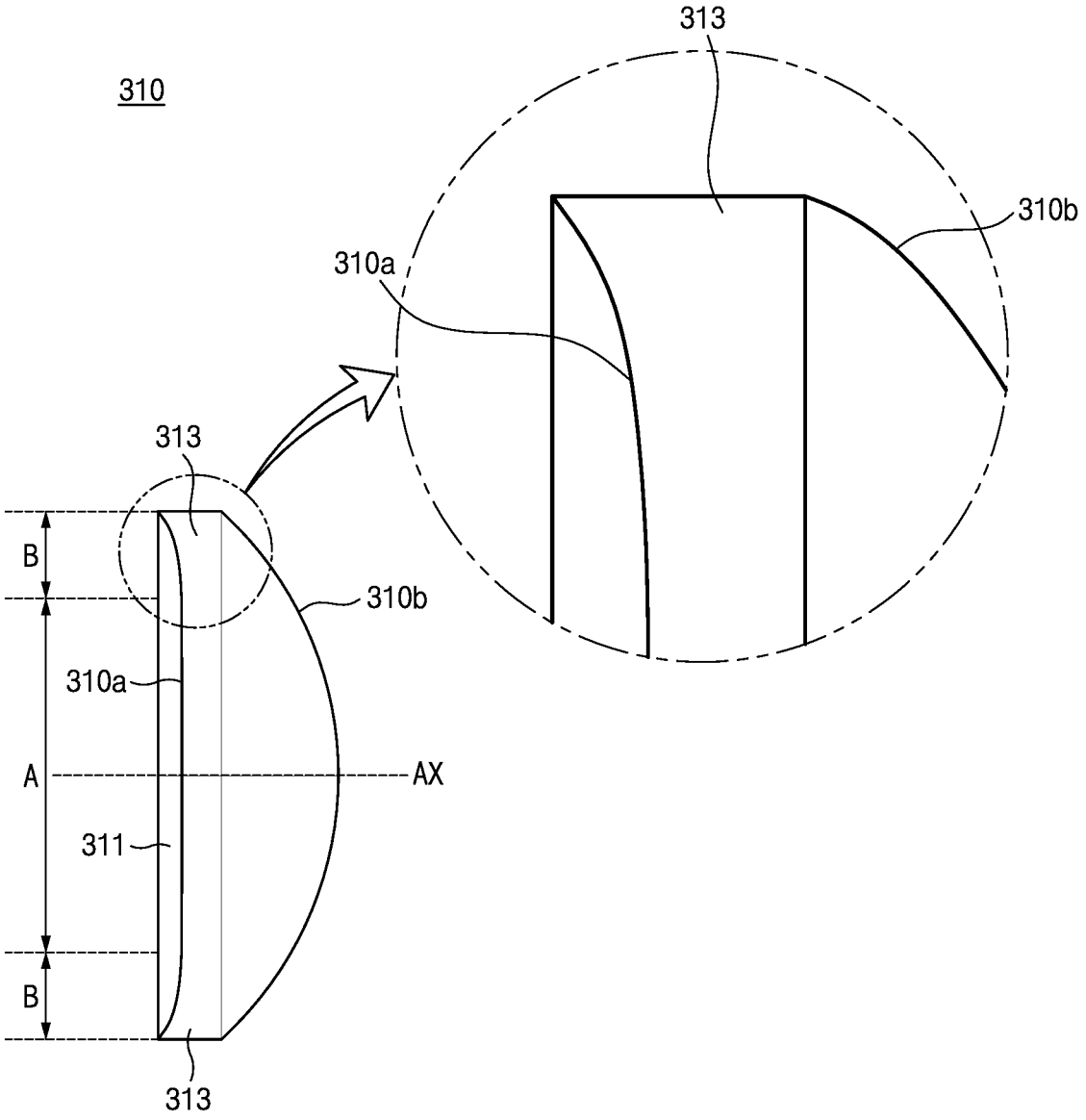
FIG. 5 is a cross-sectional view of a first lens according to an embodiment of the present disclosure.

FIG. 1 is a view illustrating an example, in which a lamp for a vehicle is installed in a vehicle according to an embodiment of the present disclosure. FIG. 2 is a perspective view schematically illustrating a configuration of a lamp for a vehicle according to an embodiment of the present disclosure. FIG. 3 is a side view schematically illustrating a configuration of a lamp for a vehicle according to an embodiment of the present disclosure. FIG. 4 is a cross-sectional view illustrating a configuration, in which a lamp for a vehicle is mounted in an interior of a housing, according to an embodiment of the present disclosure. FIG. 5 is a cross-sectional view of a first lens according to an embodiment of the present disclosure.

Figure 6:
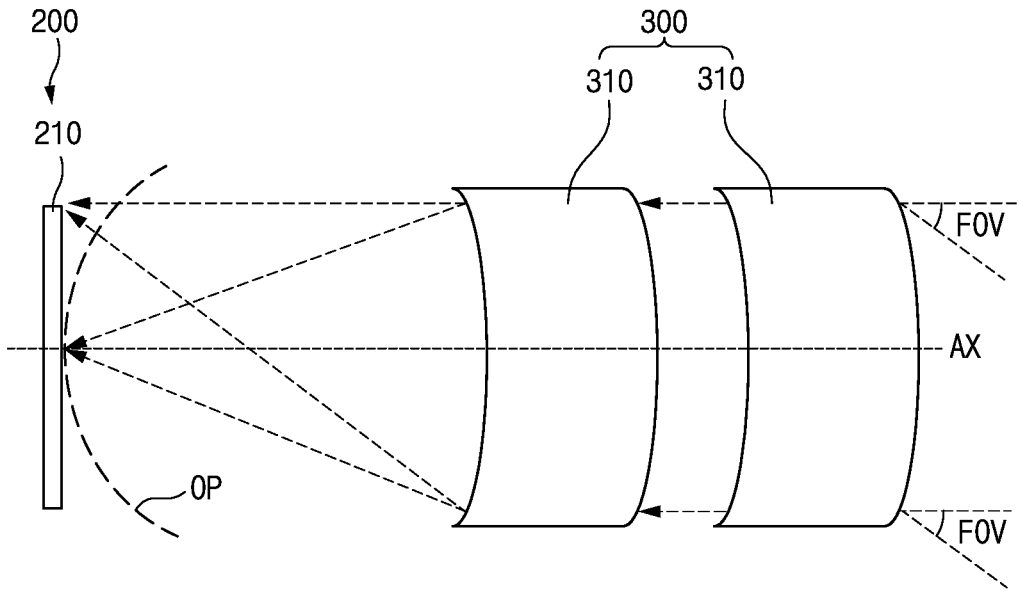
FIG. 6 is a view illustrating an aberration reducing effect according to an embodiment of the present disclosure, and is a view schematically illustrating a lens part including a plurality of lenses.
Figure 7:
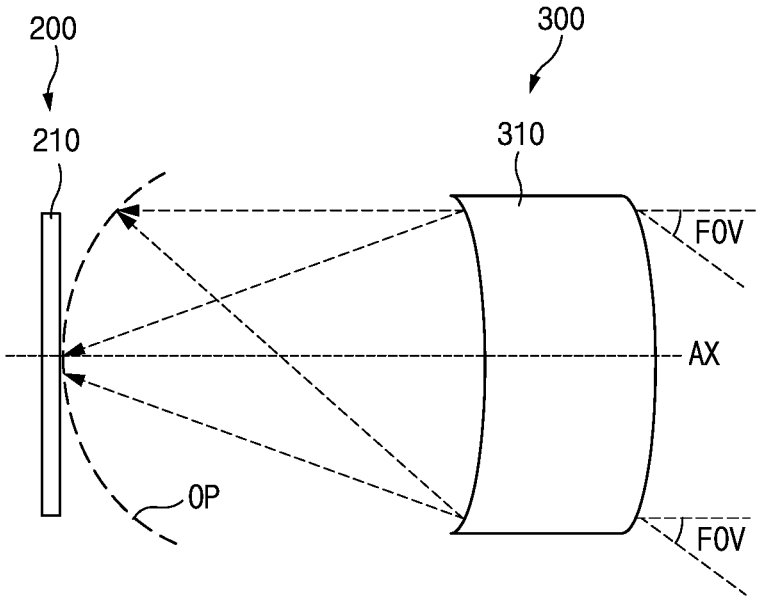
FIG. 7 is a view illustrating a comparative example of the present disclosure, and is a view illustrating a lens part including one lens.
Figure 8:
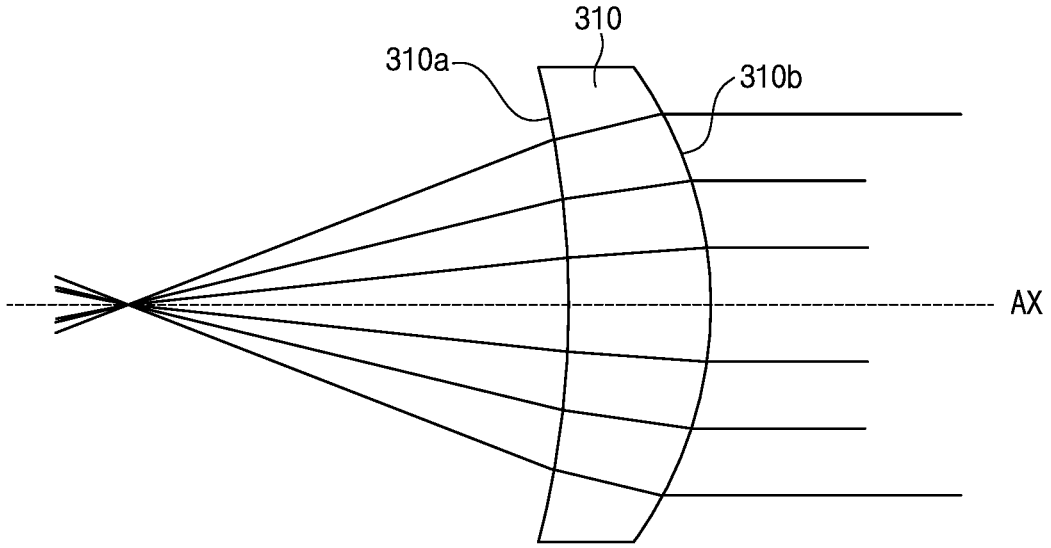
FIG. 8 is a view illustrating an aberration correcting effect according to an embodiment of the present disclosure.
Figure 9:
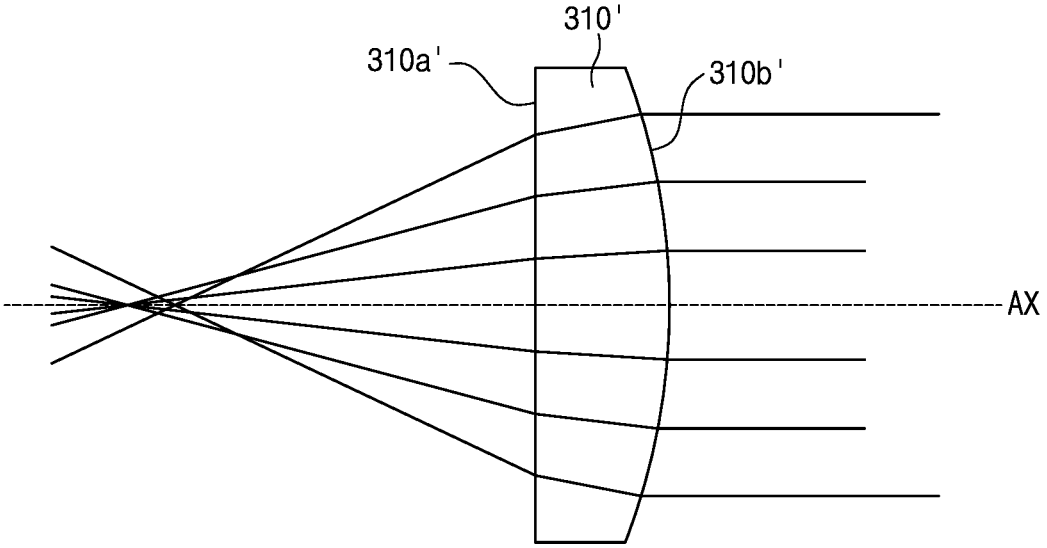
FIG. 9 is a view illustrating a comparative example of the present disclosure.

FIG. 6 is a view illustrating an aberration reducing effect according to an embodiment of the present disclosure, and is a view schematically illustrating a lens part including a plurality of lenses. FIG. 7 is a view illustrating a comparative example of the present disclosure, and is a view illustrating a lens part including one lens. FIG. 8 is a view illustrating an aberration correcting effect according to an embodiment of the present disclosure. FIG. 9 is a view illustrating a comparative example of the present disclosure.

A lamp 10 for a vehicle according to the present disclosure, for example, may be a guide lamp that project light on a road surface 2 that is adjacent to a vehicle to implement a pattern image of a specific shape on the road surface 2. As an example, the lamp 10 for a vehicle according to the present disclosure may be a rear guide lamp, a welcome guide lamp, or a turn signal guide lamp that is turned on or off together with a rear lamp. Hereinafter, a case in which the lamp 10 for a vehicle according to the present disclosure is a rear guide lamp will be described as an example. However, the lamp 10 for a vehicle according to the present disclosure is not limited to the guide lamp, but may be various lamps provided in the vehicle. Furthermore, the present disclosure is not limited to the rear guide lamp when the lamp 10 is a guide lamp, but may be applied to various lamps that irradiate specific patterns on the road surface 2.

Referring to FIGS. 1 to 6 and 8, the lamp 10 for a vehicle according to the embodiment of the present disclosure includes a light source part 100, a shield part 200, and a lens part 300.

The light source part 100 may be configured to irradiate light in a direction that faces the road surface 2. The light source part 100 may include a light source 110 and a condensing member 130. For example, the light source 110 may be configured to irradiate light and may be a light emitting diode (hereinafter, referred to as an "LED"), but the present disclosure is not limited thereto. The condensing member 130 may condense the light irradiated from the light source 110 and input or direct the condensed light to the shield part 200 and the lens part 300. The condensing member 130 may be a collimator that converts the light emitted from the light source 110, such as an LED, to a light that is parallel to an optical axis AX and inputs the light to the lens part 300.

The shield part 200 may be disposed adjacent to and on an output side of the light source part 100, and may be configured to shield a portion of the light irradiated from the light source part 100 to form a specific beam pattern 11.

In detail, the shield part 200 may be disposed between the light source part 100 and the lens part 300, and may shield the portion of the light irradiated from the light source part 100 to form the specific beam pattern 11. For example, the shield part 200 may have a planar shape that is perpendicular to the optical axis AX, and may implement a predesigned optical pattern by shielding a portion of the light that is input in parallel by the condensing member 130. However, the shape of the shield part 200 is not limited to the above description.

In more detail, the shield part 200 may include a shield area 210 and a through area 230. The shield area 210 is an area that shields light, and the through area 230 is an area that transmits light and outputs the light to the lens part 300. In the shield part 200, an image of a pattern projected to the road surface 2 may be changed according to a shape of the through area 230. Furthermore, the embodiment of the present disclosure, unlike the conventional lamp 10 for a vehicle that uses a reflection surface, may implement patterns of various images by providing the shield part 200 including the shield area 210 and the through area 230.

Furthermore, the shield part 200 may include a plurality of through areas, and the plurality of through areas may have different shapes. Accordingly, the lamp 10 for a vehicle according to the present disclosure may implement a plurality of patterns with one light source 110 due to the shield part 200. Furthermore, according to the present disclosure, complex patterns such as an arrow and a warning notification, as well as a simple rectangular beam pattern 11 may be clearly implemented.

Furthermore, the shield part 200 may be replaceable. For example, the shield part 200, which will be described below, may be assembled to be separable instead of being integrally fixed to a housing 20 in an interior of the housing 20. Accordingly, a pattern of the road surface 2 having various shapes may be implemented by using one light source module. Accordingly, by using the lamp 10 for a vehicle according to the present disclosure, various opinion expressions, such as a turn signal, a welcome guide light, and a warning symbol, as well as a simple form for a backup guide may be made.

The lens part 300 may be disposed on an output side of the shield part 200, and may include a plurality of lenses configured to project light irradiated from the light source part 100 and disposed to be spaced apart from each other in the optical axis AX.

In detail, the lens part 300 may be disposed in a direction, in which the light input from the light source part 100 is output, and may be configured to project the light to the road surface 2. The lens part 300 may include a plurality of lenses, and for example, may include two lenses as in the illustrated embodiment and may include three or more lenses.

Here, at least one of the plurality of lenses is the first lens 310, a first surface 310*a* of a first lens 310, which is any one of a surface of the first lens 310, which faces the light source part 100, and a surface of the first lens 310, which faces a direction that is opposite to a direction facing the light source part 100, is concave and a second surface 310*b* of the first lens 310, which is a surface that is opposite to the first surface 310*a*, is convex. That is, among the two surfaces of the first lens 310, the concave surface may be the first surface and the convex surface may be the second surface.

For example, the first lens 310 may be configured such that the surface facing the light source part 100 is concave and the surface in a direction that is opposite to a direction facing the light source part 100 is convex. However, the shape of the first lens 310 is not limited thereto, and the surface facing the light source part 100 may be convex and the surface in the direction that is opposite to the direction facing the light source part 100 may be concave.

In detail, the first lens 310 may be a meniscus lens having a concave/convex lens shape that is configured such that the first surface 310*a* that is an input surface, to which the light irradiated from the light source part 100 is input, and the second surface 310*b* that is an output surface is convex. In the specification, among the plurality of lenses constituting the lens part 300, a lens of a meniscus lens is defined as the first lens 310.

The lamp 10 for a vehicle according to the present disclosure may improve an aberration improving effect because the lens part 300 includes the plurality of lenses and at least one of the plurality of lenses is the meniscus lens. Accordingly, because a resolution may be increased by using the present disclosure, a pattern of a precise image may be implemented and thus, an optical performance may be improved.

Here, aberration refers to a phenomenon, in which when several rays that exit from a point object passes through an imaging optical system to form an image, the rays do not gather at one point and some of them deviate (see FIG. 9). When aberrations occur in the optical system, a clear image or pattern cannot be obtained. In general, in the optical system of the lamp 10 for a vehicle, aberrations may occur due to the shape characteristics of the lenses or the color of the light. In particular, in the embodiment of the present disclosure, when the shield part 200 has a planar shape, non-axial aberrations occur so that a level of completion of the patterns may become very low (see FIGS. 6 and 7).

Accordingly, the present disclosure may correct spherical aberrations and astigmatisms by providing the first lens 310 that is the meniscus lens to the lens part 300. In detail, in order to decrease aberrations that occur in the lens, a material of the lens and a radius of curvature of the spherical surface may be changed or a plurality of lenses having different optical characteristics may be used. The lens part 300 according to the present disclosure may minimize aberrations by using the plurality of lenses and providing the meniscus lens having a convex shape to the output side thereof.

Here, one or a plurality of first lenses 310 may be provided. Because at least one of the plurality of lenses is the first lens 310 in the lens part 300, the one or the plurality of first lenses 310 may be provided. That is, the lens part 300 may include one or a plurality of meniscus lenses. Furthermore, the plurality of first lenses 310 may have different sizes. In the illustrated embodiment, it is illustrated that two first lenses 310 are provided.

As in the illustrated embodiment, the aberration correcting effect may be excellent when both of the two lenses are meniscus lenses in the configuration of the lens part 300 including the two lenses as compared with a case, in which one meniscus lens is provided. However, because it is not easy to manufacture the meniscus lens as compared with a general aspheric lens, costs may increase. Accordingly, when it is possible to obtain a sufficient aberration improving effect with one meniscus lens, the lens part 300 may include one meniscus lens.

Meanwhile, the first lens 310 according to the present disclosure may be classified into a central portion 311 and an edge portion 313. The central portion 311 is located at a central area of the first lens 310, and the edge portion 313 is located at an edge area of the first lens 310 and is disposed at a circumference of the central portion 311. In the cross-sectional view illustrated in FIG. 5, the central portion 311 may be area "A" and the edge portion 313 may be area "B".

Here, the edge portion 313 and the central portion 311 may be located within a clear aperture of the first lens 310. That is, the edge portion 313 and the central portion 311 are areas that are classified in a clear aperture of the first surface and a clear aperture of the second surface.

Here, an absolute value of a radius of curvature of the first surface 310*a* of the edge portion 313 may be smaller than an absolute value of a radius of curvature of the first surface 310*a* of the central portion 311.

In detail, the first lens 310 is a meniscus lens having a shape that is convex in an output direction of the light as a whole, and in the first surface 310*a* of the first lens 310, the absolute values of the radii of curvature of the central portion 311 and the edge portion 313 may be different.

Because the first surface 310*a* has a shape that is substantially close to a plane and the second surface 310*b* has a convex shape in the area of the central portion 311, the shape of the central portion 311 may be a shape that is close to a plane-convex (PCX) lens. However, for easiness of manufacturing, the first surface 310*a* of the central portion 311 may have a specific radius of curvature instead of being a perfect plane when a lens is injection-molded and formed.

Meanwhile, in order to correct an aberration, an absolute value of a radius of curvature of the first surface 310*a* of the edge portion 313 may be smaller than an absolute value of a radius of curvature of the first surface 310*a* of the central portion 311. Accordingly, a whole shape of the first lens 310 may be a shape of a meniscus lens.

Furthermore, as in the illustrated embodiment, in the first lens 310, an absolute value of the radius of curvature of the first surface 310*a* may be different from an absolute value of the radius of curvature of the second surface 310*b*.

Furthermore, an absolute value of a radius of curvature of the first surface 310*a* of the edge portion 313 may be larger than an absolute value of a radius of curvature of the second surface 310*b* of the edge portion 313. That is, a curved surface of the first surface 310*a* of the edge portion 313 may be formed more smoothly.

In detail, the absolute value of the radius of curvature of the second surface 310*b* that is the output surface may be smaller than the absolute value of the radius of curvature of the first surface 310*a*. In more detail, the absolute value of a radius of curvature of the second surface 310*b* of the edge portion 313 may be smaller than the absolute value of the radius of curvature of the first surface 310*a* of the edge portion 313. Then, the absolute values of the radii of curvature of the first surface 310*a* and the second surface 310*b* may be determined to be large enough to minimize the aberration in consideration of the design specification of the lamp 10 for a vehicle. However, the radius of curvature of the first surface 310*a* and the radius of curvature of the second surface 310*b* are not limited to the above-ones, but various forms may be applied as long as the lens is a meniscus lens that is convex toward the output side.

In this way, the present disclosure may correct the aberration more effectively by making the absolute values of the radii of curvature of the first surface 310*a* and the second surface 310*b* of the first lens 310 different and making the absolute values of the radii of curvature of the central portion 311 and the edge portion 313 of the first surface 310*a* different.

Meanwhile, as described above, the lens part 300 according to the embodiment of the present disclosure may be one, in which only the number of the first lenses 310 that are meniscus lenses are plural and meniscus lenses and lenses that are not meniscus lenses are included together. In detail, the lens part 300 may further include a second lens that is disposed while sharing the same optical axis AX with the first lens 310.

Here, the second lens may be a lens that is not a meniscus lens. A more excellent aberration correcting effect may be shown in the case of a plurality of meniscus lenses, but any one of the plurality of lenses may be a meniscus lens when a sufficient aberration correcting effect may be obtained only with one meniscus lens.

Hereinafter, an effect of the case in which the lens part 300 includes the plurality of lenses will be described with reference to FIGS. 6 and 7. For convenience of description, the same reference numerals will be used in the embodiment (see FIG. 6) of the present disclosure and a comparative example (FIG. 7).

FIGS. 6 and 7 illustrate images through the lens part 300 that is an imaging optical system, and here, the shield part 200 may function as an object of the lens part 300. The shield part 200 may be provided in a planar shape that is perpendicular to the optical axis AX and may be a focal plane of the lens part 300. An OP may be a surface of the object when one lens part 300 is provided. Here, the object is a target of imaging by the optical system, and may be an object that is present actually like the shield part 200 and may be an imaginary focus by one lens like the OP. For reference, FOV is an abbreviation for field of view, and a size of the shield part 200 that is a focal plane may be determined in consideration of the FOV of the lens part 300.

Referring to FIG. 7, because the shield part 200 has a planar shape, an aberration for a non-axial plane may occur when the lens part 300 includes a single lens. Accordingly, the actual focal plane and the OP do not coincide with each other, and some of the rays that pass through the lens part 300 deviate from the shield part 200 that is the actual focal plane. In this case, a pattern that is to be implemented by the shield part 200 becomes blurred so that the level of completion of the pattern becomes lower.

Meanwhile, as illustrated in FIG. 6, the lens part 300 according to the embodiment of the present disclosure includes a plurality of lenses, and FIG. 6 illustrates an example of including two lenses. In this case, one of the lenses may be used for the purpose of projecting the shape of the shield part 200 to an image surface (for example, the road surface 2), and the other may be used for the purpose of decreasing a non-axial aberration of the shield part 200 to implement a clear image.

Referring to FIG. 6, because the two lens parts 300 are provided, most of the rays that pass through the lens part 300 may gather in the shield part 200 that is a focal plane, and accordingly, aberrations may be minimized. Accordingly, the resolution increases and the pattern that is to be implemented by the shield part 200 may be implemented clearly. In particular, even when the plurality of through areas 230 are formed in the shield part 200 to implement a plurality of patterns, the plurality of patterns may be precisely implemented.

Meanwhile, hereinafter, a spherical aberration correcting effect of the meniscus lens will be described with reference to FIGS. 8 and 9. FIG. 8 illustrates a meniscus lens applied to the first lens 310 of the present disclosure. FIG. 9 illustrates a plane-convex (PCX) lens 310' as a comparative example.

Referring to FIG. 9, because the plane-convex lens 310' refracts light less on the second surface 310*b*' and refracts the light more on the first surface 310*a*', spherical aberrations increase as a whole. Meanwhile, referring to FIG. 8, the first lens 310 that is the meniscus lens refracts the light more on the second surface 310*b* than the convex-plane lens 310' and refracts the light less on the first surface 310*a*. Accordingly, the first lens 310 may refract the light less than the plane-convex lens 310' as a whole, and thus, spherical aberrations and spot size may be decreased by using the meniscus lens.

In this way, according to the present disclosure, as the lens part 300 includes the meniscus lens, aberrations may be corrected without using a large number of lenses, and thus a small-sized optical system may be implemented.

Meanwhile, referring to FIG. 4, the embodiment of the present disclosure may further include the housing 20. The housing 20 may have an interior space, in which the light source part 100, the shield part 200, and the lens part 300 are sequentially accommodated. That is, the housing 20 may function as a body tube, on which the members are mounted, to maintain distances between the light source part 100, the shield part 200, and the lens part 300 constantly.

For example, an inner surface of the housing 20 may be stepped such that an inner diameter thereof increases as it goes from the light source part 100 to the lens part 300. However, the shape of the inner surface of the housing 20 is not limited to the above-described one, but may be variously modified according to the sizes of the members accommodated in the interior space. For example, the inner diameter of the housing 20 may become smaller as it goes from the light source part 100 to the lens part 300. Hereinafter, a case in which the inner diameter of the housing 20 increases as it goes from the light source part 100 to the lens part 300 will be described as an example.

In more detail, a light source mounting part 21, a shield mounting part 22, and a lens mounting part 23 are formed in an interior of the housing 20.

The light source mounting part 21 may be configured such that the light source part 100 is mounted thereon. In detail, the condensing member 130 of the light source part 100 may be mounted on the light source mounting part 21, and an inner diameter of the light source mounting part 21 may correspond to an outer diameter of the condensing member 130.

Furthermore, the shield mounting part 22 may be stepped from the light source mounting part 21 to have a diameter that is larger than that of the light source mounting part 21, and the shield part 200 may be mounted on the shield mounting part 22. The shield mounting part 22 may correspond to a shape of an edge of the shield part 200. However, the present disclosure is not limited thereto, but the shield mounting part 22 may be shaped such that a portion of the edge of the shield part 200 is allowed to be inserted thereinto and is fixed.

The lens mounting part 23 may be stepped from the shield mounting part 22 to have an inner diameter that is larger than that of the shield mounting part 22, and at least one of the plurality of lenses may be mounted thereon. For example, as in the illustrated embodiment, when the lens part 300 includes the plurality of lenses, locations and shapes of the lens mounting part 23 may be determined such that the plurality of lenses may be fixed, respectively. However, the stepped shapes of the light source mounting part 21, the shield mounting part 22, and the lens mounting part 23 are not limited to the above-described ones.

Due to the shape of the housing 20, the present disclosure may stably assemble the light source part 100, the shield part 200, and the lens part 300 while maintaining the intervals therebetween.

Meanwhile, a vehicle 1 according to an embodiment of the present disclosure includes the lamp 10 for a vehicle. The lamp 10 for a vehicle includes the light source part 100, the shield part 200 disposed on an output side of the light source part 100, and that shields a portion of light irradiated from the light source part 100 to form a specific beam pattern, and the lens part 300 disposed on an output side of the shield part 200, that projects light irradiated from the light source part 100, and including a plurality of lenses disposed in an optical axis (AX) direction.

Furthermore, at least one of the plurality of lenses is the first lens 310, in which the first surface 310*a* of the first lens 310, which faces the light source part 100, is concave and the second surface 310*b* of the first lens 310, which is a surface that is opposite to the first surface 310*a*, is convex.

Here, the first lens 310 includes the central portion 311 located at a central area of the first lens 310, and the edge portion 313 located at an edge area of the first lens 310 and disposed at a circumference of the central portion 311, and an absolute value of a radius of curvature of the first surface 310*a* of the edge portion 313 is smaller than an absolute value of a radius of curvature of the first surface 310*a* of the central portion 311.

The lamp for a vehicle according to the present disclosure may improve an aberration improving effect because the lens part includes the plurality of lenses and at least one of the plurality of lenses is the meniscus lens. Accordingly, because a resolution may be increased by using the present disclosure, a pattern of a precise image may be implemented and thus, an optical performance may be improved.

The lamp for a vehicle according to the present disclosure may improve an aberration improving effect because the lens part includes the plurality of lenses and at least one of the plurality of lenses is the meniscus lens.

Accordingly, because a resolution may be increased by using the present disclosure, a pattern of a precise image may be implemented and thus, an optical performance may be improved.

Furthermore, according to the present disclosure, a plurality of patterns may be implemented with one light source due to the shield part.

Although the specific embodiments of the present disclosure have been described until now, the spirit and scope of the present disclosure are not limited to the specific embodiments, and may be variously corrected and modified by an ordinary person in the art, to which the present disclosure pertains, without changing the essence of the present disclosure claimed in the claims.

What is claimed is:

1. A lamp for a vehicle, comprising:

a light source part configured to irradiate light;

a shield part disposed adjacent to the light source part and configured to shield at least a portion of the light irradiated from the light source part to form a beam pattern; and a lens part disposed adjacent to the shield part and configured to project the light irradiated from the light source part, wherein the lens part comprises a plurality of lenses spaced apart from each other in an optical axis direction of the lens part, first lens having:

a concave first surface facing the light source part; and a convex second surface facing opposite to the first surface, wherein a first radius of curvature of the first surface at an edge portion of the first lens is smaller than a second radius of curvature of the first surface at a central portion of the first lens.

2. The lamp of claim 1, wherein the edge portion is located within a clear aperture of the first lens.

3. The lamp of claim 1, wherein the first lens comprises a plurality of first lenses.

4. The lamp of claim 1, wherein the first surface of the first lens has a third radius of curvature that is different from a fourth radius of curvature of the second surface of the lens.

5. The lamp of claim 1, wherein the first radius of curvature of the first surface at the edge portion of the first lens is greater than a third radius of curvature of the second surface at the edge portion of the first lens.

6. The lamp of claim 1, wherein the lens part further comprises a second lens having an optical axis coaxial with that of the first lens.

7. The lamp of claim 1, wherein the light source part includes:

a light source configured to irradiate the light; and a condensing member configured to condense the light irradiated from the light source and direct the condensed light to the lens part.

8. The lamp of claim 1, further comprising a housing having an interior space, wherein the light source part, the shield part and the lens part are positioned at the interior space of the housing.

9. The lamp of claim 8, wherein the housing contains:

a light source mounting part, wherein the light source part is mounted on the light source mounting part;

a shield mounting part on which the shield part is mounted, spaced apart from the light source mounting part; and a lens mounting part on which at least one of the plurality of lenses is mounted, spaced apart from the shield mounting part.

10. A vehicle comprising a lamp, wherein the lamp includes:

a light source part configured to irradiate light;

a shield part positioned adjacent to the light source part and configured to shield at least a portion of the light irradiated from the light source part to form a beam pattern; and a lens part positioned adjacent to the shield part and configured to project the light irradiated from the light source part, the lens part comprising a plurality of lenses disposed in an optical axis direction of the lens part, wherein the plurality of lenses comprises a first lens having:

a concave first surface facing the light source part; and a convex second surface facing opposite to the first surface, and wherein a first radius of curvature of the first surface at an edge portion of the first lens is smaller than a second radius of curvature of the first surface at a central portion of the first lens.

* * * * *